US009309673B1

(12) United States Patent
Tscharner

(10) Patent No.: US 9,309,673 B1
(45) Date of Patent: Apr. 12, 2016

(54) PROTECTIVE STAKE CAP FOR MOUNTING ON TOP OF A METAL STAKE

(71) Applicant: Eric Tscharner, Denver, CO (US)

(72) Inventor: Eric Tscharner, Denver, CO (US)

( * ) Notice: Subject to any disclaimer, the term of this patent is extended or adjusted under 35 U.S.C. 154(b) by 0 days.

(21) Appl. No.: 14/810,746

(22) Filed: Jul. 28, 2015

(51) Int. Cl.
*E04H 12/00* (2006.01)
*E04C 5/16* (2006.01)
*E04G 21/32* (2006.01)

(52) U.S. Cl.
CPC ..... *E04C 5/161* (2013.01); *E04G 21/3252* (2013.01)

(58) Field of Classification Search
CPC ..... E04H 2017/006; E04G 21/3252; E04C 5/161; H01B 17/145
See application file for complete search history.

(56) References Cited

U.S. PATENT DOCUMENTS 4,520,231 A * 5/1985 Hubbell ..... H01B 17/145 174/158 F
4,623,756 A * 11/1986 Wilson, Jr. ..... H01B 17/145 174/158 F
4,680,428 A * 7/1987 Wilson, Jr. ..... H01B 17/145 174/158 F
5,381,636 A * 1/1995 Kassardjian ..... B29C 45/14065 138/96 R
D363,657 S * 10/1995 Kassardjian ..... D8/354
5,729,941 A * 3/1998 Kassardjian ..... E04C 5/161 248/523
5,943,836 A * 8/1999 Kassardjian ..... E04G 21/32 248/523
5,956,875 A * 9/1999 Aughenbaugh ..... G09F 7/10 256/48
D416,335 S * 11/1999 Roy ..... D25/131
6,330,998 B1 * 12/2001 Roy ..... E04H 17/12 256/19
6,563,055 B1 * 5/2003 Burdick ..... H01B 17/145 174/138 G
6,612,082 B2 * 9/2003 Schimmelpfennig ... E04C 5/161 248/523
6,612,551 B1 * 9/2003 Roy ..... E04H 17/12 256/1
6,691,479 B1 * 2/2004 Tscharner ..... A01G 17/14 135/118
6,857,235 B2 * 2/2005 Niday ..... E04C 5/161 248/188.9
D554,274 S * 10/2007 Roy ..... D25/133
D554,777 S * 11/2007 Roy ..... D25/133
8,113,473 B2 * 2/2012 Bradley ..... E04H 12/2253 174/158 F
8,646,735 B2 * 2/2014 Bradley ..... E04H 12/2253 248/121
D703,011 S * 4/2014 Tscharner ..... D8/1
8,770,552 B2 * 7/2014 Rawls ..... A01K 3/005 256/10
8,776,464 B2 * 7/2014 Kassarjian ..... E04G 21/3252 138/96 R
D711,698 S * 8/2014 Tscharner ..... D8/1
2005/0210773 A1 * 9/2005 Steffes ..... E04H 17/20 52/169.9
2006/0027796 A1 * 2/2006 O'Connor ..... A01K 3/00 256/1
2008/0168726 A1 * 7/2008 Yang ..... E04C 5/161 52/301

* cited by examiner

*Primary Examiner* — Brian Mattei
*Assistant Examiner* — Gisele Ford

(57) ABSTRACT

A protective stake cap adapted for mounting on top of a metal stake. The stake cap includes a hard plastic, tubular, hollow housing. The hollow housing includes a closed top and an open bottom. The open bottom is adapted for receiving a top portion of the metal stake inside the hollow housing. The inside of the housing includes four pair of parallel, spaced apart ribs. The ribs are designed to engage, in a press fit, a top portion of three sides of a metal stake having a "T" shaped cross section. One of each pair of ribs includes a rib fin. The rib fin is used to engage a top of the metal stake. Also, the rib fin is used to hold smaller diameter metal stakes, such as rebar, in a press fit.

6 Claims, 2 Drawing Sheets

PROTECTIVE STAKE CAP FOR MOUNTING ON TOP OF A METAL STAKE

BACKGROUND OF THE INVENTION (a) Field of the Invention

This invention relates to a protective stake cap and more particularly but not by way of limitation, to a single piece, hard plastic, stake cap adapted for receipt over a top portion of a metal stake having a "T" shaped cross section. The metal stake is used for fencing and other applications.

(b) Discussion of Prior Art

In U.S. Pat. No. 6,691,479, to the subject inventor, a two-piece, hard plastic, protective stake cover is disclosed for mounting on top of a metal stake. The stake cover is designed to cover a top portion of the metal stake and prevent injury should someone fall and hit the top of the protective stake cover when working or playing nearby. In U.S. Design Pat. No. D771,698, to the subject inventor, a single piece, hand plastic, protective stake cover is illustrated having a hollow housing with four pair of spaced apart ribs. The ribs are used for receiving a top portion a metal stake. The above mentioned patents do not disclose the unique features, advantages, and objects of the subject protective stake cap as disclosed herein.

SUMMARY OF THE INVENTION

In view of the foregoing, it is a primary objective of the subject invention to provide a protective stake cap to cover a top portion of a metal stake and the like and designed to help prevent injury should someone fall or hit the top of the stake cap.

Another object of the invention is the stake cap is adapted for quickly mounting on the top portion of the metal stake.

Still another object of the invention is the stake cap is simple in design, inexpensive to use and reuse, and can be easily attached to various types of metal stakes and posts used in the farming and ranching industries, construction industry, and other industries.

The protective stake cap includes a hard plastic, tubular, hollow housing having a closed top and an open bottom. The open bottom adapted for receiving a top portion of a metal stake inside the hollow housing. The inside of the housing includes four pair of parallel, spaced apart ribs. The ribs are designed to engage, in a press fit, a top portion of three sides of a metal stake having a "T" shaped cross section.

These and other objects of the present invention will become apparent to those familiar with different types of stake caps and stake covers when reviewing the following detailed description, showing novel construction, combination, and elements as described, and more particularly defined by the claims, it being understood that changes in the embodiments of the invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject protective stake cap, and in which.

DETAILED DESCRIPTION OF THE PREFERRED EMBODIMENTS

Figure 1:
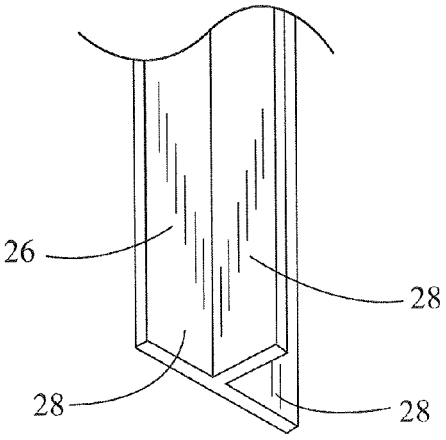
FIG. 1 illustrates a perspective view of the subject protective stake cap with a portion of the cap cut away. The cap is shown mounted on a top portion of a metal stake. The stake has a "T" shaped cross section.

In FIG. 1, a perspective view of the subject protective stake cap is shown and having general reference numeral 10. The stake cap 10 includes a tubular, hollow housing 12 with a closed top 14 and an open bottom 16. An inside 18 of the housing 12 includes four pair of vertical, parallel, spaced apart ribs 20. A top portion of the ribs 20 include a rib fin 22 extending inwardly from one of the ribs into a center of the hollow housing 12. In this drawing, a portion of the hollow housing 12 has been cut away to illustrate the ribs 20 and the rib fins 22 inside the housing.

A top portion 24 of a metal stake 26 is shown received inside the hollow housing 12. The metal stake 26 has a "T" shaped cross section with three sides 28. The sides 28 can slide inside or outside the vertical ribs 20 in a press fit inside the cap 10. A top of the stake 26 is shown engaging a bottom of two of the rib fins 22.

Figure 2:
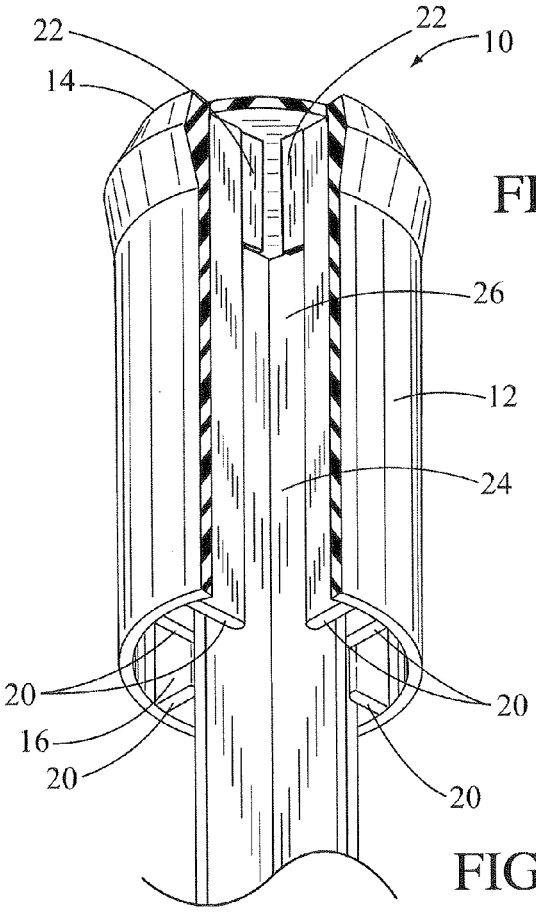
FIG. 2 is a top view of the stake cap.
Figure 2:
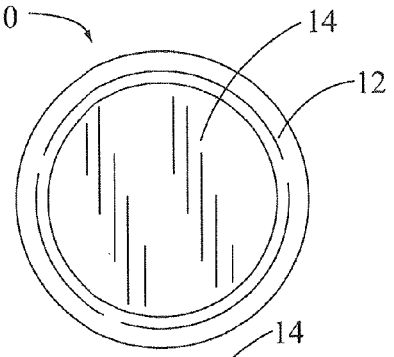

In FIG. 2, the closed top 14 of the stake cap 10 is shown.

Figure 3:
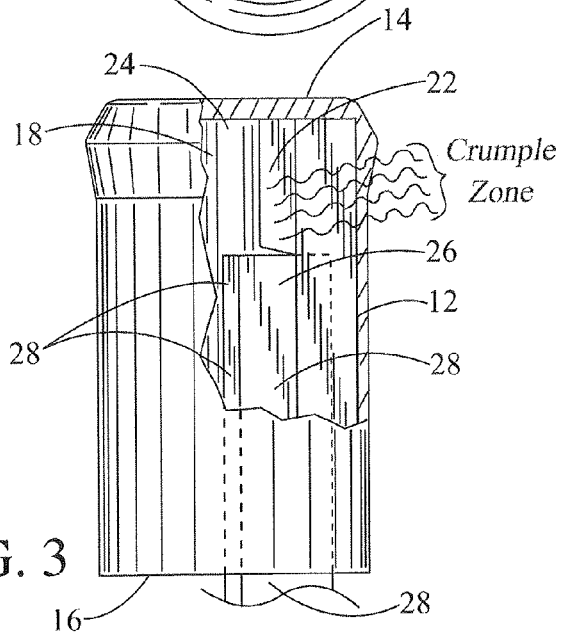
FIG. 3 illustrates a side view of the stake cap with a portion of the cap cut away for exposing a top of the metal stake engaging a bottom of a rib fin.

In FIG. 3, a side view of the stake cap 10 is illustrated with a portion of the housing 12 cut away for exposing the top portion 24 of the metal stake 26 engaging a bottom of one of the rib fins 22. In this drawing, the top of the metal stake 26, illustrated in dashed lines, is shown crumpling the rib fin 22 upwardly. This feature is important in that the rib fins 22 act to provide a crumple zone should the closed top 14 of the stake cap 10 be hit by a sharp blow, thus compressing the cap downwardly.

Figure 4:
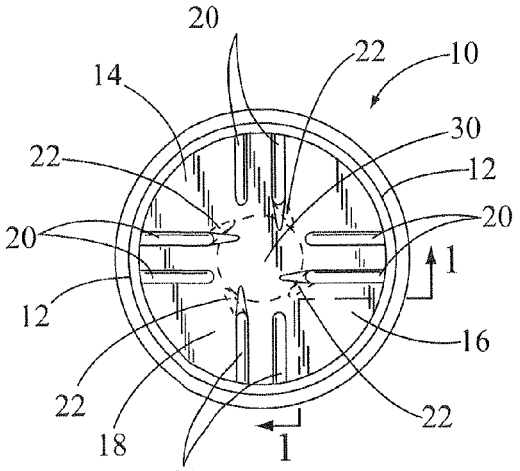
FIG. 4 is a bottom view of the stake cap.

In FIG. 4, a bottom view of the stake cap 10 is shown. In this view, the four pair of ribs 22 are shown equally spaced 90 degrees apart and around an inner circumference of the hollow housing 12. It should be noted that by having four pair of ribs 22 inside the hollow housing 12, three sides 28 of the metal stake 26 can easily be inserted between three of the four pair of ribs 22 when the cap 10 is inserted on top of the stake, as shown in FIG. 1 or the three sides 28 can be inserted outside the ribs 22.

Also shown in this drawing are the four rib fins 22 in dotted lines and rotated away from the parallel ribs 20. When receiving a smaller diameter metal stake, such as a rebar 30 shown in dashed lines and shown in FIGS. 5 and 6, a top portion of the rebar 30, having an annular cross section, can be treaded next to the sides of the rib fins 22 with the rebar held in a tight fit. While rebar is shown in the drawings, it should be kept in mind that other types of metal stakes can be used equally well with the subject stake cap 10.

Figure 5:
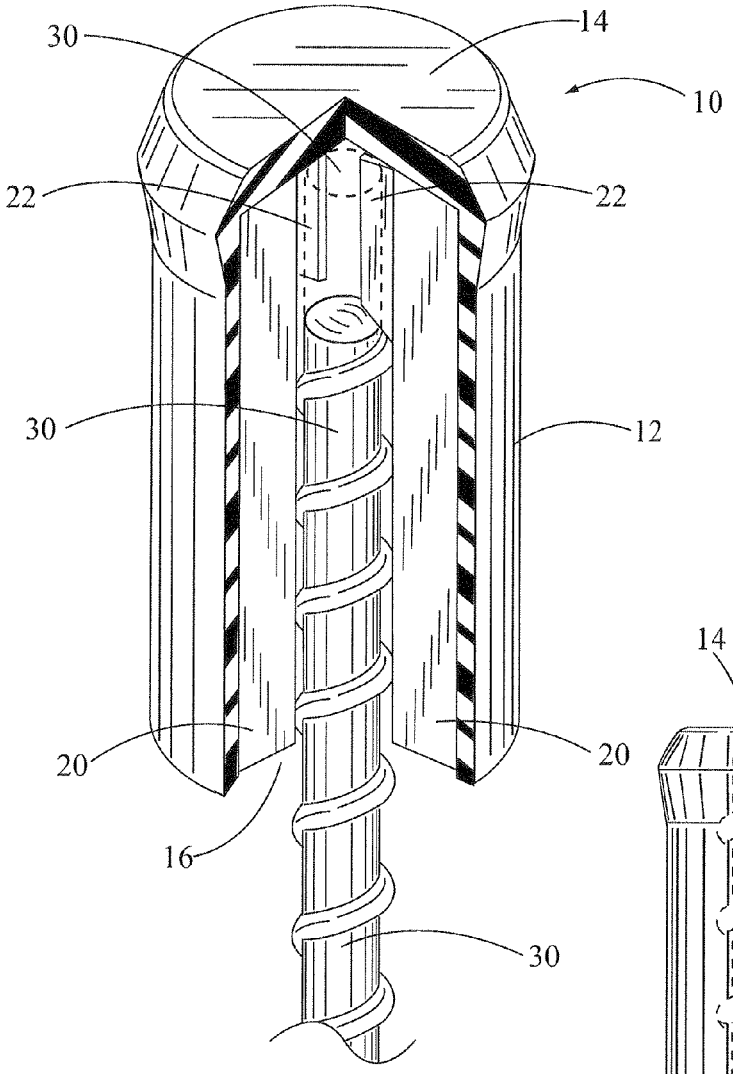
FIG. 5 is a perspective view of the stake cap with a portion of the cap cut away. The cap is shown receiving a top portion of a metal rebar.

In FIG. 5, a perspective view of the stake cap 10 is shown receiving a top portion of the metal rebar 30. A portion of the hollow housing 12 has been cut away and illustrating sides of the parallel ribs 20. In this drawing, a top of the rebar 30 is shown engaging a bottom of two of the rib fins 22. When rotating and moving the rebar 30 upwardly into the inside of the cap 10, the rib fins 22 are rotated outwardly allowing the top of the rebar, shown in dashed lines, to engage the rib fins 22 in a press fit for holding the rebar inside the stake cap.

Figure 6:
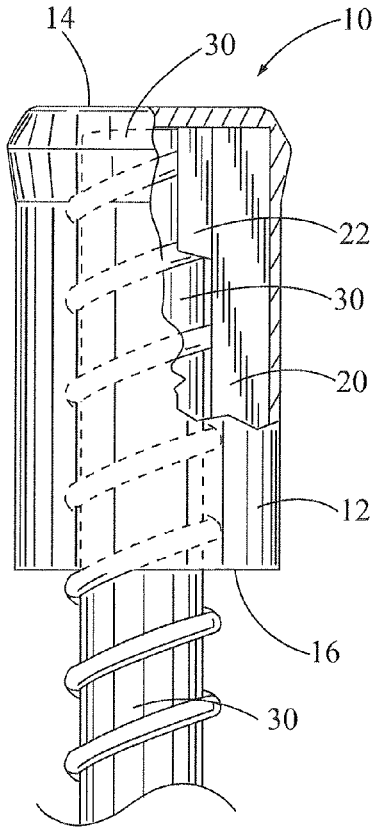
FIG. 6 is a side view of the stake cap with a portion of the cap cut away to expose the rebar held in a press fit inside the cap.

In FIG. 6, a side view of the stake cap 10 is shown with a portion of the hollow housing 12 cut away to expose the rebar 30. In this drawing, the top of the rebar is shown in solid lines and engaging a bottom of a rib fin 22. Also, the rebar 30 is shown in dashed lines and held in a press fit next to the rib fins 22 and inside the cap.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right are claimed are defined as follows:

1. A protective stake cap adapted for mounting on a metal stake or on a metal rebar, the stake cap comprising:

a hard plastic, tubular, hollow housing, the hollow housing having a closed top and an open bottom, the open bottom adapted for receiving a top portion of the metal stake or a top portion of the metal rebar inside the hollow housing;

four pair of spaced apart ribs, the ribs disposed around an inner circumference of the hollow housing, the ribs adapted for engaging a top portion of sides of the metal stake or engaging a top portion of sides of the metal rebar; and at least one rib fin, the rib fin mounted on a top of a rib and extending inwardly beyond the rib toward a center of the hollow housing, the rib fin adapted for engaging a top of the metal stake when the top of the housing is hit by a sharp blow and compressing the stake cap downwardly creating a crumple zone, the rib fin adapted for engaging a top of the metal rebar in a press fit.

2. The stake cap as described in claim 1 wherein the metal stake has a "T" shaped cross section with three sides, three pair of the spaced apart ribs adapted for engaging the three sides of the metal stake in a press fit.

3. The stake cap as described in claim 1 wherein the four pair of spaced apart ribs extend inwardly inside the hollow housing, the for pair of ribs disposed 90 degrees apart.

4. The stake cap as described in claim 1 wherein each of the four pair of ribs include a rib fin.

5. A protective stake cap adapted for mounting on a metal stake or on a metal rebar, the stake cap comprising:

a hard plastic, tubular, hollow housing, the hollow housing having a closed top and an open bottom, the open bottom adapted for receiving a top portion of the metal stake or a top portion of the metal rebar inside the hollow housing;

four pair of spaced apart ribs, the ribs disposed around an inner circumference of the hollow housing, the ribs adapted for engaging a top portion of sides of the metal stake or engaging a top portion of sides of the metal rebar; and rib fins, the rib fins mounted on a top of the spaced apart ribs and extending inwardly beyond the rib toward a center of the hollow housing, the rib fins adapted for engaging a top of the metal stake when the top of the housing is hit by a sharp blow and compressing the stake cap downwardly creating a crumple zone, the rib fin adapted for engaging a top of the metal rebar in a press fit.

6. The stake cap as described in claim 5 wherein the four pair of spaced apart ribs are disposed 90 degrees apart inside the hollow housing.

* * * * *